US006014781A

United States Patent [19]

Cone, II

[11] Patent Number: 6,014,781

[45] Date of Patent: Jan. 18, 2000

[54] PORTABLE JUVENILE CRIB

[75] Inventor: Richard E. Cone, II, Athens, Ohio

[73] Assignee: Cosco, Inc., Columbus, Ind.

[21] Appl. No.: 09/168,234

[22] Filed: Oct. 7, 1998

Related U.S. Application Data

[60] Provisional application No. 60/066,218, Nov. 20, 1997.

[51] Int. Cl.[7] ..... A47D 7/01; A47D 7/03

[52] U.S. Cl. ..... 5/99.1; 403/99

[58] Field of Search ..... 5/99.1, 93.1, 98.1; 256/25; 403/99, 102, 103

[56] References Cited

U.S. PATENT DOCUMENTS

| | | | |
|---|---|---|---|
| 2,536,357 | 1/1951 | David | 5/99.1 |
| 2,553,579 | 5/1951 | Harris | 5/99.1 |
| 2,561,637 | 7/1951 | Rex | 5/99.1 |
| 5,560,055 | 10/1996 | Ziegler . | |
| 5,746,533 | 5/1998 | Schmidt | 403/102 |

FOREIGN PATENT DOCUMENTS

| | | | |
|---|---|---|---|
| 310769 | 1/1956 | Switzerland | 5/99.1 |

OTHER PUBLICATIONS

Gerry Sales Brochure, pp. 32–33 showing Model Nos. 8252, 8352, and 8582.

*Primary Examiner*—Alexander Grosz
*Attorney, Agent, or Firm*—Barnes & Thornburg

[57] ABSTRACT

A juvenile crib frame includes first and second frame portions and a lock mechanism including a first member mounted for rotation on the first frame portion about a first axis and a second member mounted for rotation on the second frame portion about a second axis. The lock mechanism further includes a hinge pin arranged to couple the first member to the second member to cause the first member to pivot relative to the second member about a pivot axis that is perpendicular to at least one of the first and second axes.

35 Claims, 6 Drawing Sheets

PORTABLE JUVENILE CRIB

This appln claims the benefit of U.S. Provisional Ser. No. 60/066,218 filed Nov. 20, 1997.

BACKGROUND AND SUMMARY OF THE INVENTION

The present invention relates to cribs, and particularly, to portable juvenile cribs. More particularly, the present invention relates to collapsible, portable juvenile cribs.

One issue facing day-care centers, hotels, and motels is that sturdy, inexpensive juvenile cribs are frequently needed for customers. The cribs must be sturdy enough for the day-to-day use of day-care center and hotel/motel customers, yet simple to set up and take down.

According to the present invention, a frame is provided for supporting a mattress to provide a juvenile crib. The frame includes a first frame portion, a second frame portion, and a lock mechanism interconnecting the first frame portion and the second frame portion. The lock mechanism has a first member mounted for rotation on the first frame portion, a second member mounted for rotation on the second frame portion, and a hinge pin that couples the first member to the second member. The lock mechanism is mounted between the first and second frame portions for pivotal movement of the first member relative to the second member about an axis defined by the hinge pin that is perpendicular to the axis of rotation of at least one lock mechanism member relative to its companion frame portion.

In preferred embodiments, the frame is collapsible from an open position to a compact, folded position. In the open position, the frame is rectangular to receive the mattress in a horizontal, bedding position. In the compact position, the frame collapses on itself to assume a narrow configuration to facilitate movement and storage of the frame.

Also in preferred embodiments, the frame is foldable to define a channel therein that is adapted to receive and store a mattress once the frame is moved to its collapsed, storage position. Thus, the mattress that is supported in the opened frame can be stored in the collapsed frame as the collapsed frame is moved about on its casters.

Also in preferred embodiments, the first and second members of the lock mechanism rotate about the first and second frame portions between a locked position and an unlocked position to enable the frame to be moved from an open, usable position to a collapsed, portable position. In the locked position, the hinge pin of the lock mechanism is substantially horizontal and in the unlocked position, the hinge pin is substantially vertical. In the locked position, the hinge pin is substantially horizontal so that the first frame portion cannot pivot relative to the second frame portion. In the unlocked position, the hinge pin is substantially vertical so that the first frame portion can pivot relative to the second frame portion about the hinge pin of the lock mechanism.

Additional features and advantages of the invention will become apparent to those skilled in the art upon consideration of the following detailed description of preferred embodiments of the invention exemplifying the best mode of carrying out the invention as presently perceived.

BRIEF DESCRIPTION OF THE DRAWINGS

The detailed description particularly refers to the accompanying figures in which:

FIG. 3 shows the crib in the collapsed position and the mattress-support platform and mattress being removed from a storage position defined by the collapsed crib;

FIG. 4 shows the crib being partially opened from the collapsed, portable position with the lock mechanisms being in an unlocked position;

FIG. 5 shows the crib in a fully-opened, usable position with the lock mechanisms being in a locked position and the mattress-support platform being positioned to lie on the mattress-support clips situated near the bottom of the crib frame;

FIG. 6 shows the crib in the fully-opened, usable position, the mattress-support platform being supported on the clips, and the mattress being positioned on the mattress-support platform;

DETAILED DESCRIPTION OF THE DRAWINGS

Figure 1:
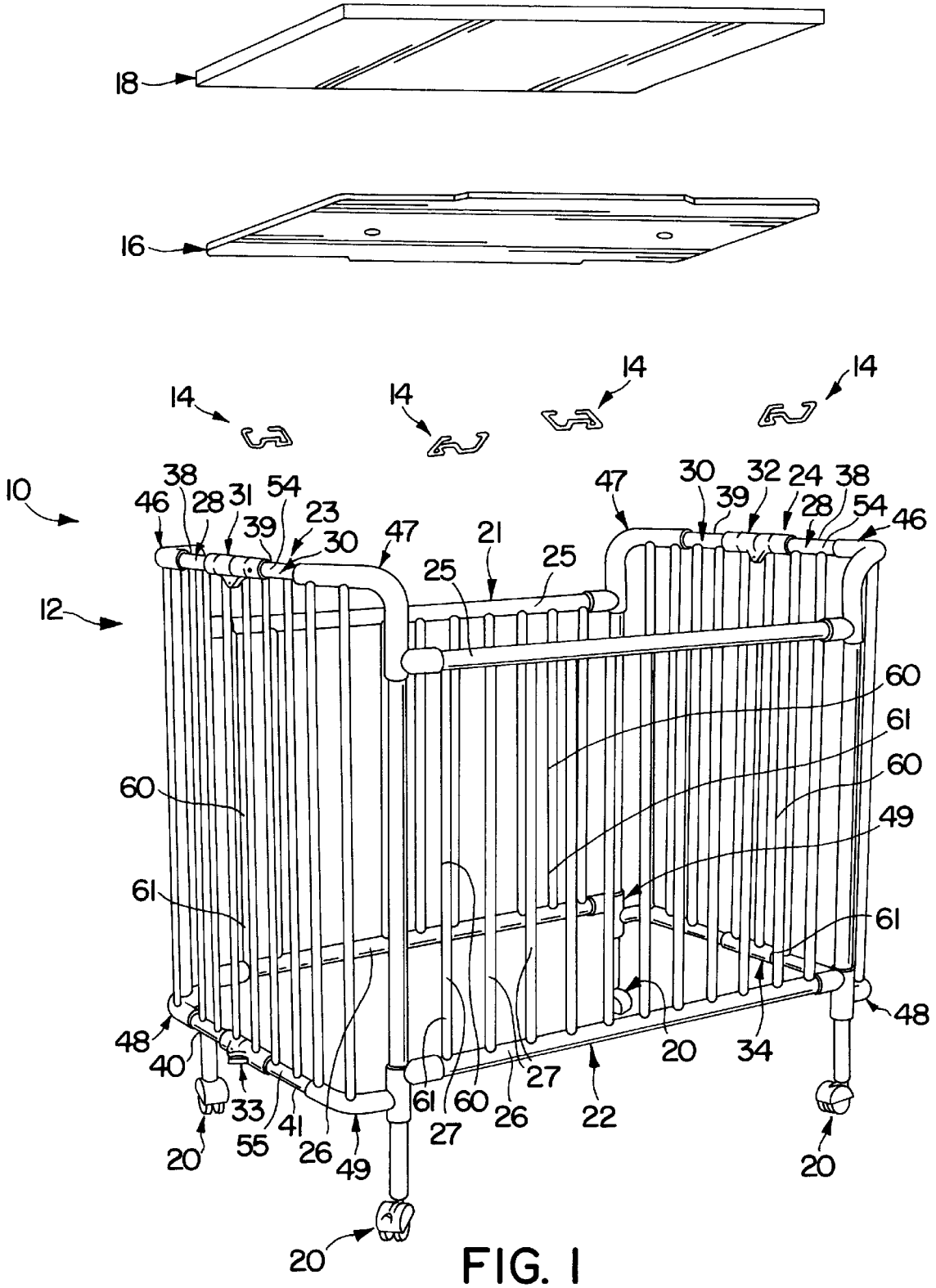
FIG. 1 is an exploded perspective view of a portable juvenile crib in accordance with the present invention showing a frame mounted on four casters, four mattress-support clips, a mattress-support platform, and a mattress, the frame having a pair of side panels and a pair of bifold end panels interconnecting the side panels, each bifold end panel including a lock mechanism positioned to lie on a top rail segment and a stationary hinge positioned to lie on a bottom rail segment to permit the frame to move from an open, usable position to a collapsed, portable position.
Figure 3:
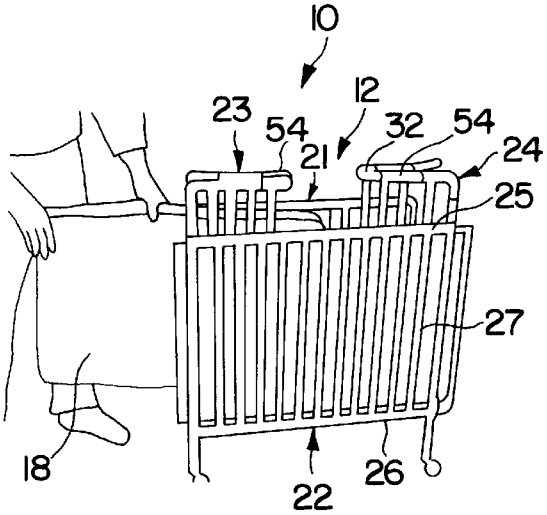
FIGS. 3–6 show the crib of FIG. 1 being moved from a collapsed, portable position (shown in FIG. 3) to a fully-opened, usable position (shown in FIG. 6)
Figure 16:
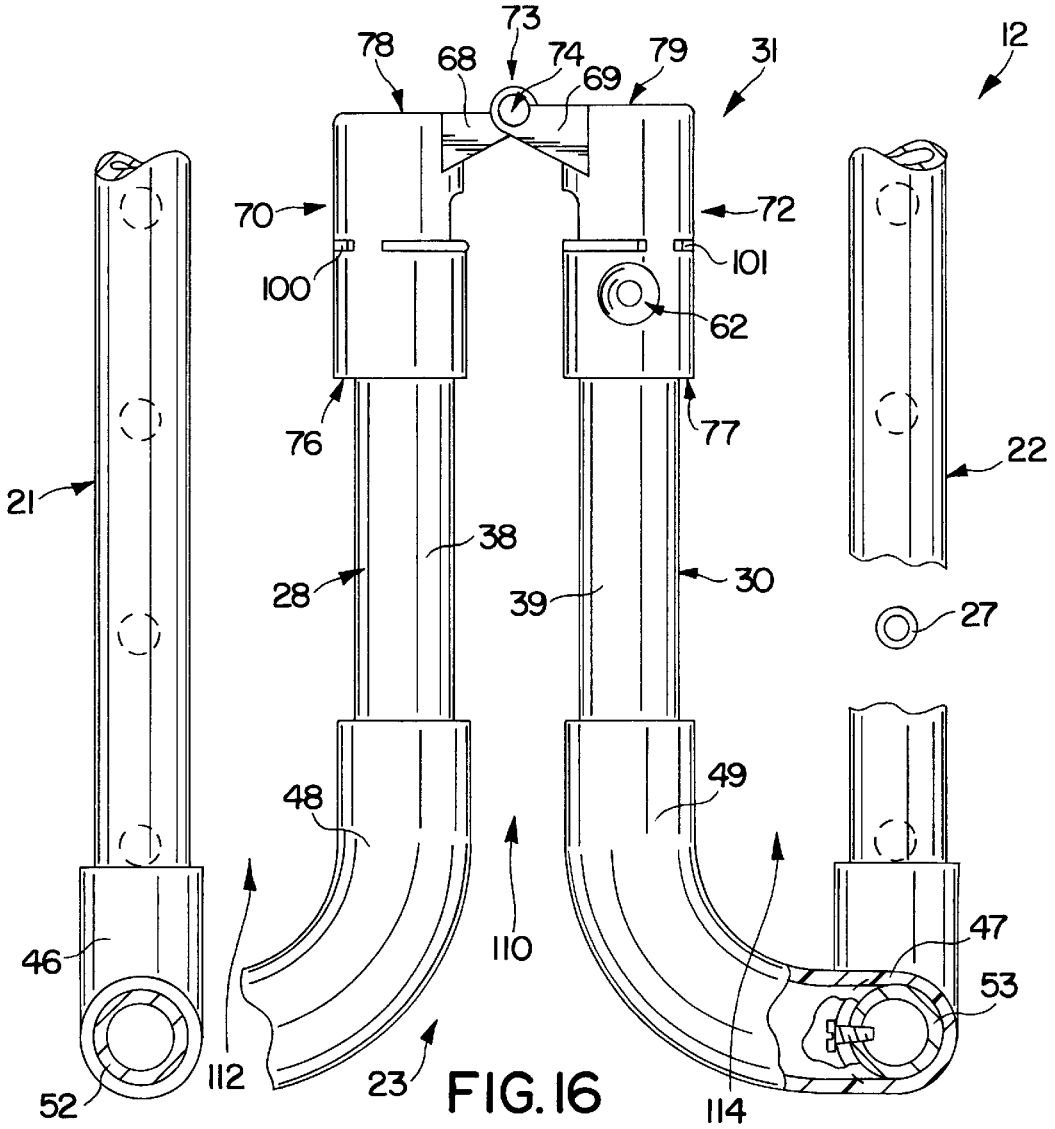
FIG. 16 is a top view of a portion of the crib of FIGS. 1–15 showing the crib after the bifold end panels have been folded inwardly to fully collapse the frame.

A portable juvenile crib 10 is illustrated in FIG. 1. Crib 10 includes a frame 12, four mattress-support clips 14, a mattress-support platform 16, and a mattress 18. Frame 12 is foldable from an open, bedding position (FIGS. 1, 7, 8) to a compact, folded position (FIGS. 3, 16). As shown in FIG. 1, frame 12 includes a pair of opposing side panels 21, 22 that are coupled to a pair of opposing, bifold end panels 23, 24. Each bifold end panel 23, 24 includes a lock mechanism 31, 32 and a stationary hinge 33, 34 that enable frame 12 to move between the open and folded positions.

Figure 12:
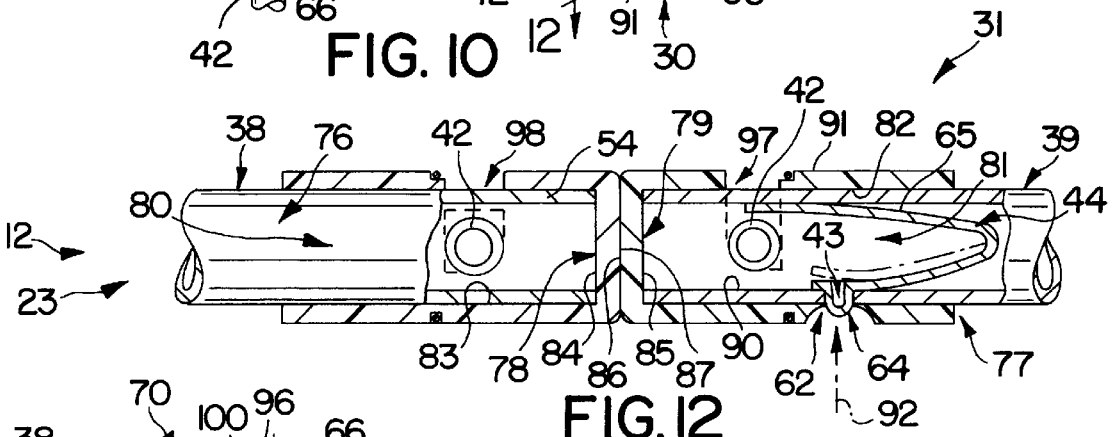
FIG. 12 shows a caregiver pushing the lock member of FIGS. 10 and 11 inwardly to permit the lock mechanism to be rotated about the top spindles of left and right spindle sets to assume an unlocked position.
Figure 13:
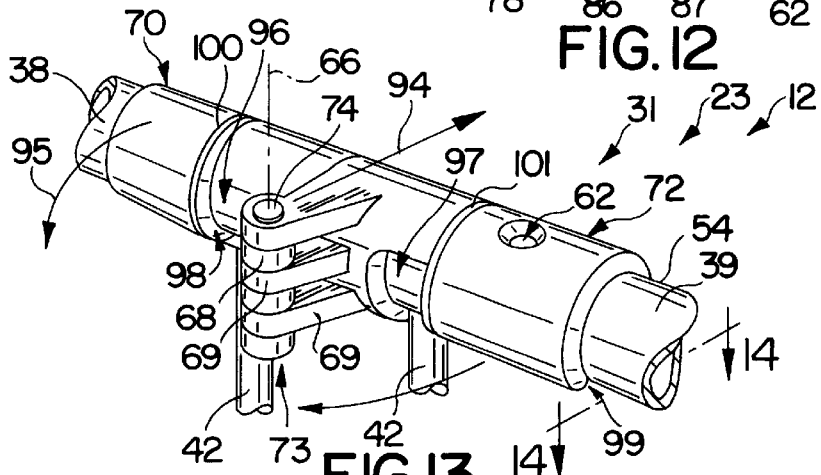
FIG. 13 is a view similar to FIG. 10 showing the lock mechanism after the lock mechanism has been rotated to the unlocked position with the hinge pin positioned to lie in a vertical position relative to the floor so that the left and right spindle sets can be folded inwardly to collapse the crib.
Figure 14:
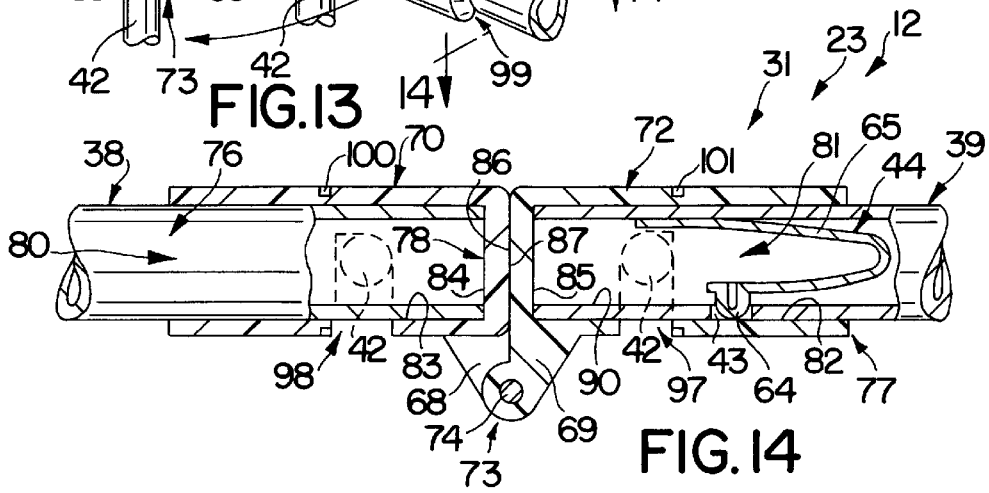
FIG. 14 is a sectional view taken along line 14—14 of FIG. 13 showing the lock mechanism in the unlocked position with the button-shaped portion of the lock member abutting an inner surface of the second member.

When the frame 12 is in the open position, the lock mechanisms 31, 32 are movable between a locked position (FIGS. 10, 12) and an unlocked position (FIGS. 13–14). With the lock mechanisms 31, 32 in the locked position, the frame 12 is locked in the open position and cannot be folded. When the lock mechanisms 31, 32 are in the unlocked position, the frame 12 is free to move between the open and folded positions.

As shown diagrammatically in FIG. 1, when crib 10 is fully assembled and frame 12 is in the open position, mattress-support clips 14 are mounted to frame 12, mattress-support platform 16 is supported by mattress-support clips 14, and mattress 18 is placed on mattress-support platform 16. Casters 20 are coupled to frame 20 to facilitate movement of crib 20 in both a collapsed and uncollapsed configuration.

Figure 2:
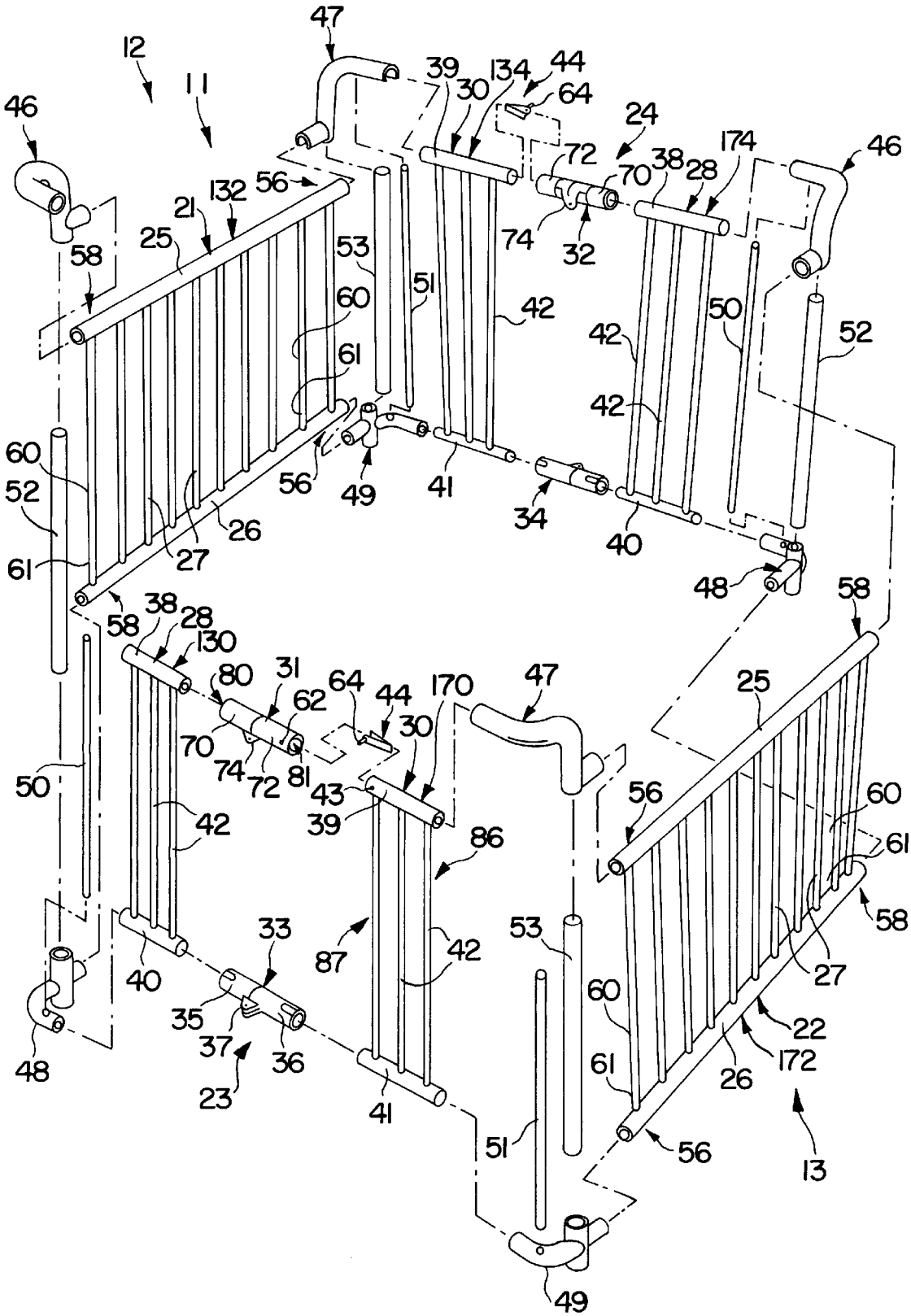
FIG. 2 is an exploded perspective view of the frame of FIG. 1, showing each bifold end panel having curved, plastic mounting brackets for interconnecting the side panels and bifold end panels and the lock mechanism and stationary hinge of each bifold end panel being formed to interconnect a left and right spindle set of each bifold end panel.

As shown in FIG. 2, opposing side panels 21, 22 are coupled to bifold end panels 23, 24 to define frame 12. Side panels 21, 22 are identical to one another and therefore the description of one side panel applies equally to the other. Each side panel 21, 22 includes a top rail 25, a bottom rail 26, and a plurality of vertical spindles 27 extending between top and bottom rails 25, 26. A set of upper holes 60 and a set of lower holes 61 are formed in a selected few vertical spindles 27 as shown in FIG. 2 for receiving mattress-support clips 14. In addition, each side panel 21, 22 has a left side 56 and a right side 58. (Note: For the purpose of this description, "left" and "right" are used as they would appear to a person viewing the crib as shown in FIG. 1 from outside the crib.) Although side panels 21, 22 and end panels 23, 34 are shown as spindle sets in the diagrams (as described below), any type of panel, wall, or partition typically used for cribs is suitable for the current invention.

Figure 5:
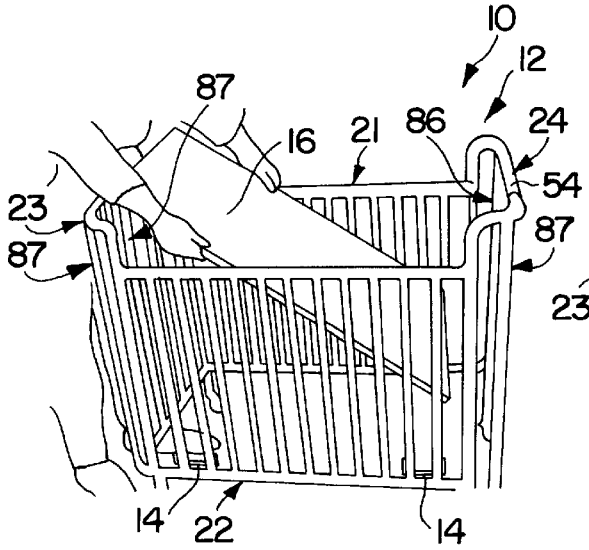
Figure 6:
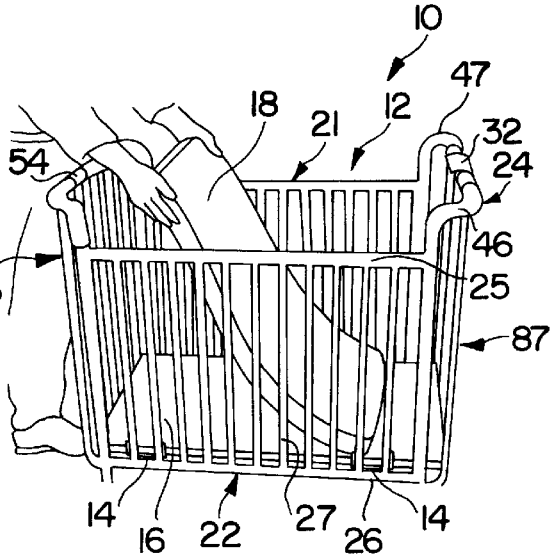

As shown in FIG. 2, bifold end panels 23, 24 are also identical. Each bifold end panel 23, 24 includes a left spindle set 28 and a right spindle set 30 that are interconnected by lock mechanisms 31, 32 and stationary hinges 33, 34. Lock mechanisms 31, 32 can be operated by a user to allow left and right spindle sets 28, 30 of bifold end panels 23, 24 to be folded inwardly so that the crib 10 can be collapsed and stored, as shown in FIG. 3. Left and right spindle sets 28, 30 of bifold end panels 23, 24 cooperate to define an inner surface 86 and an outer surface 87 of each bifold end panel 23, 24 as shown in FIG. 2. As shown in FIGS. 5 and 6, inner surface 86 faces inwardly towards a center of frame 12 and outer surface 87 faces outwardly away from frame 12.

The left spindle set 28 of each bifold end panel 23, 24 includes a top spindle 38, a bottom spindle 40, and a plurality of vertical spindles 42 extending between top and bottom spindles 38, 40, as shown in FIG. 2. Similarly, right spindle set 30 of each bifold end panel 23, 24 includes a top spindle 39, a bottom spindle 41, and a plurality of vertical spindles 42 extending between top and bottom spindles 39, 40. As shown in FIG. 12, top spindle 39 is hollow and includes an inner surface 90 that defines a passageway 81.

As shown diagrammatically in FIG. 2, for each bifold end panel 23, 24, top spindle 38 of left spindle set 28 is coupled to top spindle 39 of right spindle set 30 using lock mechanisms 31, 32. When connected by lock mechanisms 31, 32, top spindles 38, 39 cooperate to define a top rail segment 54 as shown in FIG. 1. Similarly, for each bifold end panel 23, 24, bottom spindle 40 of left spindle set 28 is connected to bottom spindle 41 of right spindle set 30 using stationary hinges 33, 34. When connected by stationary hinges 33, 34, bottom spindles 40, 41 cooperate to define a bottom rail segment 55. The only structural difference between left spindle set 28 and right spindle set 30 is that top spindle 39 of right spindle set 30 is formed to include a hole 43, shown in FIG. 2, for receiving a lock member 44 (described in more detail below) while top spindle 38 of left spindle set 28 is not formed to include a hole.

Each bifold end panel 23, 24 is connected to the opposing side panel 21, 22 using upper mounting brackets 46, 47 and lower mounting brackets 48, 49. Mounting brackets 46, 47, 48, 49 are the only curved parts used in frame 12 and they are made out of plastic. All of the straight parts are made out of either metal or plastic. Thus, all the curved parts are made from plastic, which is more cost effective. Upper mounting brackets 46, 47 and lower mounting brackets 48, 49 connect left and right spindle sets 28, 30 of bifold end panels 23, 24 to the respective side panels 22, 21 as shown in FIG. 2. Left side 56 of each side panel 21, 22 is connected to its respective bifold end panel 23, 24 using upper mounting bracket 47 and lower mounting bracket 49. Right side 58 of each side panel 21, 22 is connected to its respective bifold end panel 23, 24 using upper mounting bracket 46 and lower mounting bracket 48. Upper mounting brackets 46, 47 are substantially identical to one another and lower mounting brackets 48, 49 are substantially identical to one another except for the fact that they connect each bifold end panel 23, 24 to opposite sides 56, 58 of opposing side panels 21, 22.

Vertical support spindles 50, 51 and corner spindles 52, 53 of bifold end panel 23, 24 extend between mounting brackets 46, 47, 48, and 49 to provide support for crib 10. Vertical support spindle 50 is connected between upper mounting bracket 46 and lower mounting bracket 48 and vertical spindle 51 is connected between upper mounting bracket 47 and lower mounting bracket 49 as shown in FIG. 2. Corner spindles 52, 53 for each bifold end panel 23, 24 are also connected between upper mounting brackets 46, 47 and lower mounting brackets 48, 49 as shown in FIG. 2. Vertical support spindles 50, 51 provide support and aesthetic qualities to crib 10 and corner spindles 52, 53 allow the frame 12 to be mounted on casters 20.

Frame 12 can be described as having a first frame portion 11 and a second frame portion 13 being interconnected by lock mechanism 31. As shown in FIG. 2, first frame portion 11 is defined by left spindle set 28 of first bifold end panel 23, first side panel 21, and right spindle set 30 of second bifold end panel 24. In this configuration, left spindle set 28 of first bifold end panel 23 is a first panel 130 of first frame portion 11, side panel 21 is a second panel 132 of first frame portion 11, and right spindle set 30 of second bifold end panel 24 is a third panel 134 of first frame portion 11. Mounting brackets 46–49 and spindles 50–53 which couple first panel 130 to second panel 132 and second panel 132 to third panel 134 are also included in first frame portion 11, although a variety of other methods currently known for coupling panels together is within the scope of this invention. In addition, although first, second, and third panels 130, 132, 134 are spindle sets as shown in the drawings, the panels can be any type of panel, wall, or partition whether flat or undulating, solid or interrupted (by spindles or the like), or having circular or non-circular cross sections.

Second frame portion 13 is defined by right spindle set 30 of first bifold end panel 23, second side panel 22, and left spindle set 28 of second bifold end panel 24. In this configuration, as shown in FIG. 2, right spindle set 30 of first bifold end panel 23 is a first panel 170 of second frame portion 13, side panel 22 is a second panel 172 of second frame portion 13, and left spindle set 28 of second bifold end panel 24 is a third panel 134 of second frame portion 13. As with first frame portion 11, mounting brackets 46–49 and spindles 50–53 which couple first panel 170 to second panel 172 and second panel 172 to third panel 174 are also included in second frame portion 13, although a variety of other methods currently known for coupling panels together is within the scope of this invention. In addition, although first, second and third panels 170, 172, 174 are spindle sets as shown in FIG. 2, the panels can be any type of panel, wall, or partition whether flat or undulating, solid or interrupted (by spindles or the like), or having circular or non-circular cross sections.

Lock mechanism 31 interconnects first panel 130 of first frame portion 11 to first panel 170 of second frame portion 13. In addition, lock mechanism 32 may be used to couple third panel 134 to third panel 174. However, according to the present invention, only one lock mechanism 31 is required and therefore the coupling function of lock mechanism 32 can be accomplished by any coupling means currently known for coupling one panel to another panel. Nevertheless, two lock mechanisms 31, 32 are preferable and therefore the description of lock mechanism 31 (herein) applies equally to lock mechanism 32.

Figure 10:
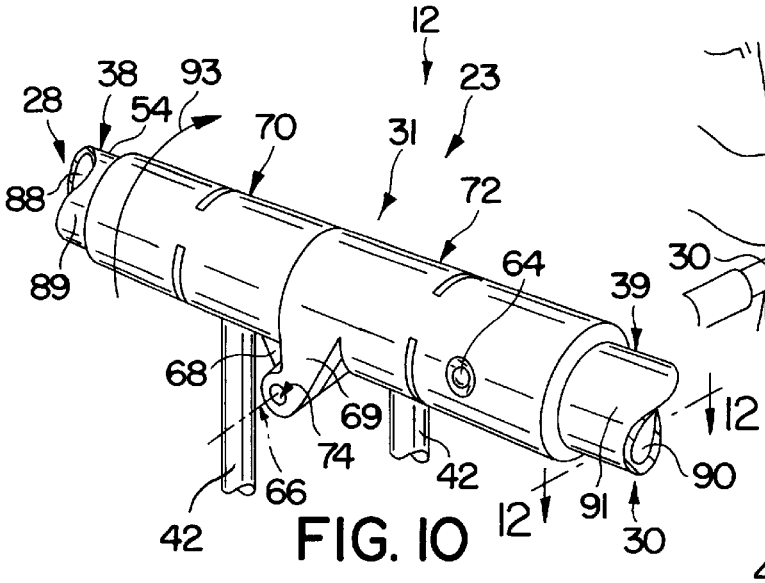
FIG. 10 is an enlarged perspective view of a portion of one of the bifold end panels of FIG. 1 showing the lock mechanism including a first member and a second member for receiving the top spindles of left and right spindle sets, the first and second members being interconnected by a hinge pin positioned to lie in an horizontal position relative to the floor.

Lock mechanism 31 couples first panel 130 of first frame portion 11 to first panel 170 of second frame portion 13. Thus, lock mechanism 31 couples left spindle set 28 to right spindle set 30 to define end panel 23. As shown in FIGS. 2, 10, and 13, lock mechanism 31 includes a first member 70, a second member 72, and a hinge 73 that pivotally connects first member 70 to second member 72. First member 70 is mounted for rotation to first panel 130 and second member 72 is mounted for rotation to first panel 170.

First and second members 70, 72 of lock mechanism 31 are tubular in shape and are each formed to define a passageway 80, 81 for receiving top spindles 38, 39 of left and right spindle sets 28, 30, as shown in FIGS. 12, 14. Thus, first and second members 70, 72 act as sleeves to allow top spindles 38, 39 of left and right spindle sets 28, 30 to be inserted into first and second members 70, 72 of lock mechanism 31. First and second members 70, 72 of lock mechanism 31 may rotate relative to the top spindles 38, 39 of left and right spindle sets 28, 30 between a locked position (see FIG. 10) and an unlocked position (see FIG. 13), as described below.

Hinge 73 includes hinge plates 68, 69 connected to first member 70 and second member 72, respectively, and a hinge pin 74 that interconnects hinge plates 68, 69 and defines a pivot axis 66. As shown in FIGS. 13 and 14, hinge plates 68, 69 interlock with one another to hold first and second members 70, 72 together. Hinge plates 68, 69 are formed to include a hole (not shown) for receiving hinge pin 74. With hinge pin 74 inserted into the holes formed in hinge plates 68, 69, first and second members 70, 72 of lock mechanism 31 can hinge about axis 66 with respect to one another.

As shown in FIG. 13, first and second members 70, 72 of lock mechanism 31 are formed to include circumferential slot portions 96, 97 to allow lock mechanism 31 to be rotated from the locked position (shown in FIG. 10) to the unlocked position (shown in FIG. 13) without being blocked by vertical spindles 42 of left and right spindle sets 28, 30. In addition, first and second members 70, 72 are formed to include longitudinal slot portions 98, 99 so that during assembly, lock mechanism 31 can be coupled to left and right spindle sets 28, 30 without hitting vertical spindles 42. Lock mechanism 31 is then kept in place on left and right spindle sets 28, 30 using a pair of retainer clips 100, 101 that prevent lock mechanism 31 from moving longitudinally past vertical spindles 42 as shown in FIG. 13.

As shown in FIG. 12, each passageway 80, 81 of first and second members 70, 72 is defined by an inner surface 82, 83 which extends from an open end 76, 77 to a closed end 78, 79. Open ends 76, 77 allow top spindles 38, 39 to extend into passageways 80, 81 and closed ends 78, 79 have inner surfaces 84, 85 that prevent top spindles 38, 39 from extending beyond the closed ends 78, 79 of first and second members 70, 72. When fully assembled, top spindles 38, 39 extend all the way into first and second members 70, 72 of lock mechanism 31 as shown in FIG. 12. Closed ends 78, 79 of first and second members 70, 72 also include outer surfaces 86, 87 that abut one another when lock mechanism 31 is in the locked position shown in FIGS. 10 and 12.

Second member 72 of lock mechanism 31 is formed to include an opening 62 for receiving lock member 44 as shown in FIG. 12. Lock member 44 is inserted into passageway 81 of top spindle 39 of right spindle set 30 so that a button-shaped portion 64 of lock member 44 extends through hole 43 in top spindle 39 and through opening 62 in second member 72. With button-shaped portion 64 extending through hole 43 and opening 62, lock mechanism 31 is situated in the locked position so that bifold end panel 23 cannot be folded inwardly. Thus, bifold end panel 23 can only be folded inwardly when lock member 44 is pushed inwardly and lock mechanism 31 is rotated to the unlocked position as shown in FIG. 13 and described in more detail below.

In order for left and right spindle sets 28, 30 of each bifold end panels 23, 24 to be folded inwardly, both lock mechanisms 31, 32 and stationary hinges 33, 34 must be free to hinge inwardly. Lock mechanisms 31, 32 are free to hinge inwardly only when in the unlocked position with hinge pin 74 substantially vertical as shown in FIG. 13. Stationary hinge 33, however, is always able to hinge inwardly. As shown in FIG. 2, stationary hinge 33 includes a left portion 35, a right portion 36, and a hinge pin 37 interconnecting left portion 35 and right portion 36. Stationary hinge 33, however, is rigidly connected between bottom spindles 40, 41 of left and right spindle sets 28, 30 so that hinge pin 37 is always in a vertical position and free to pivot and fold inwardly.

Because left and right spindle sets 28, 30 are connected by lock mechanisms 31, 32 and stationary hinges 33, 34, bifold end panels 23, 24 can only be folded inwardly when hinge pin 74 of lock mechanisms 31, 32 and hinge pin 37 of stationary hinges 33, 34 are substantially vertical. In other words, to be collapsed, lock mechanisms 31, 32 must be in the unlocked position even though stationary hinges 33, 34 are always in an "unlocked" position. Of course, the lock mechanisms 31, 32 could be coupled to the bottom rail segment 55 and the stationary hinge 34 could be coupled to the top rail segment 54. In addition, four lock mechanisms could be used for the top and bottom rail segments instead of using two lock mechanisms and two stationary hinges. However, for ease of use, lock mechanisms 31, 32 are coupled to the top rail segment 54 and stationary hinges 33, 34 are coupled to the bottom rail segment 55 as previously described.

Figure 11:
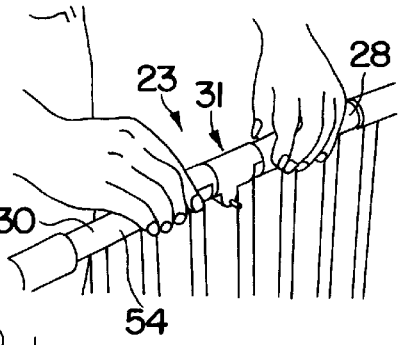
FIG. 11 is a sectional view taken along line 12—12 of FIG. 10 showing the lock mechanism in the locked position with a button-shaped portion of a lock member protruding through an opening formed in the second member to prevent rotation of the lock mechanism relative to the left and right spindle sets.

Lock member 44 for use with lock mechanisms 31, 32 is made from a flat piece of metal and is folded as shown in FIG. 12 so that it can be inserted into passageway 81 of top spindle 39 of right spindle set 30. Lock member 44 is formed to include a spring portion 65 and a button-shaped portion 64. Spring portion 65 pushes outwardly against inner surface 90 of top spindle 39 as shown in FIG. 12 so that in the locked position, button-shaped portion 64 extends through hole 43 and opening 62. A caregiver, however, can push button-shaped portion 64 inwardly, as shown in FIG. 11, so that spring portion 65 flexes inwardly in direction 92, as shown in phantom in FIG. 12. This allows lock mechanism 31 to be rotated in direction 93 as shown in FIG. 10. Then, lock mechanism 31 moves to the unlocked position shown in FIGS. 13 and 14 so that button-shaped portion 64 abuts inner surface 82 of second member 72.

Figure 4:
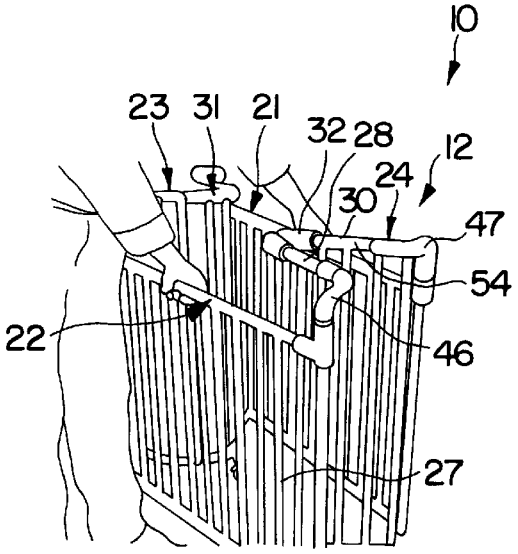

As shown in FIG. 3, when crib 10 is in a storage position, the mattress-support platform 16 and mattress 18 can be removed from within crib 10. Then, as shown in FIG. 4, crib 10 can be opened from a collapsed, portable position by pulling apart side panels 22. After crib 10 is fully opened and each lock mechanism 31, 32 on each bifold end panel 23, 24 is in the locked position (with hinge pin 74 substantially horizontal and lock member 44 extending through opening 62), mattress-support clips 14 can be inserted into holes 60, 61 in vertical spindles 27 of side panels 22. Mattress-support platform 16 may then be placed on mattress-support clips 14, as shown in FIG. 5, and mattress 18 may be placed on mattress-support platform 16, as shown in FIG. 6.

Figure 7:
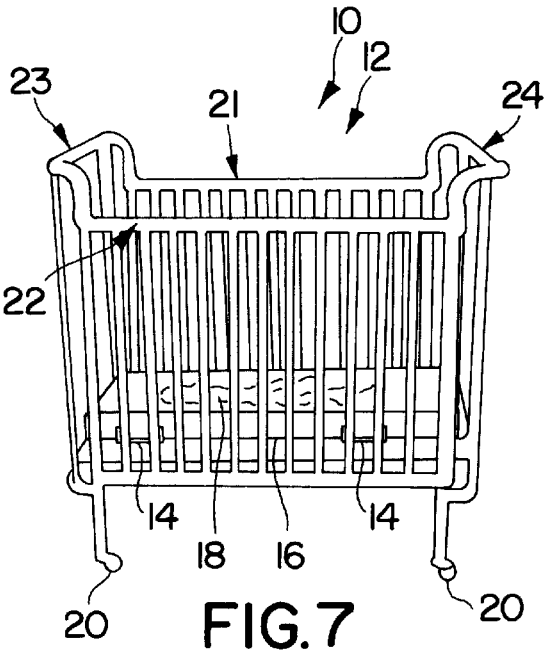
FIG. 7 shows the crib of FIG. 1 with the mattress-support platform and mattress positioned to lie in a pre-determined lowered position relative to the frame.
Figure 8:
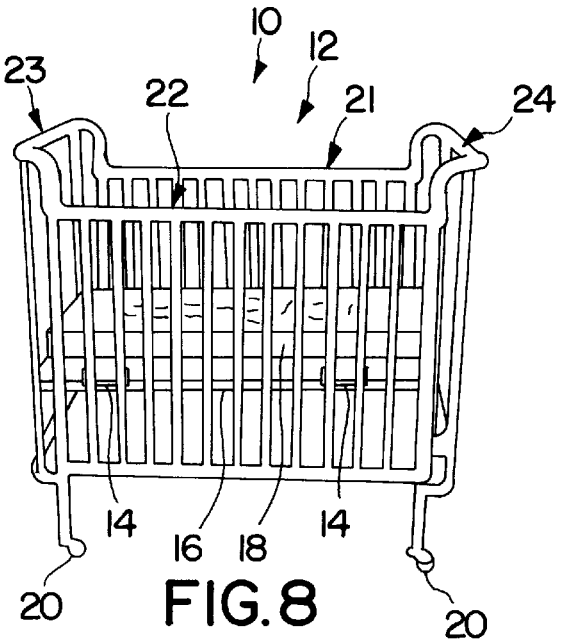
FIG. 8 is a view similar to FIG. 7 showing the mattress-support platform and mattress positioned to lie in a pre-determined elevated position relative to the frame.

As shown illustratively in FIGS. 7 and 8, there are two sets of holes 60, 61 for mounting each mattress-support clip 14. When mattress-support clips 14 are inserted into upper set of holes 60, mattress 18 is in an elevated position as shown in FIG. 8. This elevated position enables a caregiver to use crib 10 as a changing station. When mattress-support clips 14 are mounted in lower set of holes 61, mattress 18 is in a lowered position as shown in FIG. 7. This lowered position enables a caregiver to use crib 10 for a sleeping child.

Figure 9A:
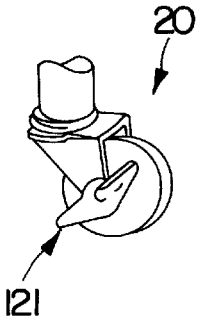
FIGS. 9*a*–9*d* are perspective views of various casters suitable for use with the crib of FIG. 1.
Figure 9B:
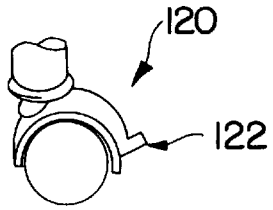
Figure 9C:
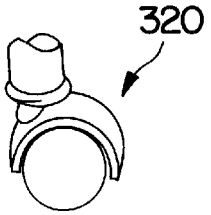
Figure 9D:
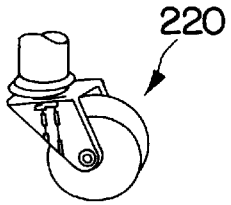

Casters 20, 120, 220, and 320 shown in FIGS. 9*a*–9*d* are suitable for use with crib 10. As shown in FIG. 1, casters 20, 120, 220, and 320 are simply inserted into corner spindles 52, 53. Casters 20, 120 shown in FIGS. 9*a* and 9*b* are positioned on the right end of crib 10 and casters 220, 320 shown in FIGS. 9*d* and 9*c* are positioned on the left end of crib 10 so that the crib can be turned when moving. Casters 20, 120 also include brakes 121, 122, respectively, that allow a parent or caregiver to activate to prevent the crib from accidentally rolling away. Although casters 20, 120, 220, and 320 are illustrated and described, it is understood that a variety of casters may be used to support crib 10 in accordance with the present invention.

A method of folding crib 10 from a fully-opened position to a fully-collapsed position is shown in FIGS. 10–16. As shown in FIG. 10, when crib 10 is fully opened and ready to be occupied by a juvenile, lock mechanisms 31, 32 are in a locked position to prevent bifold end panels 23, 24 from being folded inwardly. In the locked position, hinge pin 74 of each lock mechanism 31, 32 defines a hinging axis 66 that is substantially horizontal as shown in FIG. 10. In the horizontal position, hinge pin 74 of each lock mechanism 31, 32 provides a "primary" lock because, as described above, bifold end panels 23, 24 can only be folded inwardly when both hinge pins 74 of lock mechanisms 31, 32 and both hinge pins 37 of stationary hinges 33, 34 are substantially vertical. Thus, with hinge pin 74 substantially horizontal, bifold end panel 23 cannot be folded inwardly and bifold end panel 23 is primarily locked as shown in FIGS. 10–12.

Also in the locked position, lock mechanism 31 provides a "secondary" lock that further prevents bifold end panel 23 from inadvertently being folded inwardly. As shown in FIG. 12, button-shaped portion 64 of lock member 44 extends through hole 43 formed in top spindle 39 and through opening 62 formed in second member 72 of lock mechanism 31 to prevent lock mechanism 31 from being rotated about top rail segment 54. Thus, to hold hinge pin 74 of lock mechanism 31 in a substantially horizontal position (i.e., "primarily" locked), lock mechanism 31 of bifold end panel 23 is "secondarily" locked because lock mechanism 31 cannot be rotated from the locked position to the unlocked position without first unlocking lock member 44.

To unlock lock mechanism 31, a caregiver must first disengage the secondary lock and then disengage the primary lock. To disengage the secondary lock, the caregiver pushes button-shaped portion 64 of lock member 44 inwardly in direction 92, as shown in FIG. 12, so that button-shaped portion 64 of lock member 44 no longer extends through opening 62 formed in second member 72 of lock mechanism 31. This unlocks the secondary lock because lock mechanism 31 is now capable of being rotated about top rail segment 54 so that hinging axis 66 is no longer substantially horizontal. The caregiver can then disengage the primary lock by rotating lock mechanism 31 about top rail segment 54 in a first direction 93 shown in FIG. 10 so that lock mechanism 31 is completely unlocked as shown in FIG. 13. Thus, with lock member 44 disengaged, lock mechanism 31 can be rotated in direction 93 about top rail segment 54 to assume the unlocked position shown in FIG. 13.

In the unlocked position, shown in FIGS. 13 and 14, hinging axis 66 of hinge pin 74 is substantially vertical so that bifold end panel 23 is ready to be folded inwardly. Bifold end panel 23 can be folded inwardly because both hinge pin 74 of lock mechanism 31 and hinge pin 37 of stationary hinge 33 are now substantially vertical. In addition, as shown in FIG. 14, button-shaped portion 64 of lock member 44 no longer extends through opening 62 formed in second member 72 of lock mechanism 31. Instead, button-shaped portion 64 of lock member 44 still extends through hole 43 formed in top spindle 39, but now abuts inner surface 82 of second member 72 of lock mechanism 31. Thus, lock mechanism 31 is no longer primarily or secondarily locked because hinging axis 66 is substantially vertical and lock member 44 is disengaged from opening 62.

From the unlocked position, shown in FIGS. 13–16, lock mechanism 31 can either be rotated in a second direction 95 to return lock mechanism 31 to the locked position or pushed inwardly in direction 94 to collapse crib 10. To re-lock lock mechanism 31 after reaching the unlocked position shown in FIG. 13, lock mechanism 31 is simply rotated in direction 95 about top rail segment 54 to assume the locked position shown in FIG. 10. It is worth noting that lock mechanism 31 cannot be rotated beyond the horizontal or vertical positions because, as shown in FIG. 13, circumferential slot portions 96, 97 only permit lock mechanism 31 to rotate between the locked position (with hinging axis 66 substantially horizontal) and the unlocked position (with hinging axis 66 substantially vertical).

Figure 15:
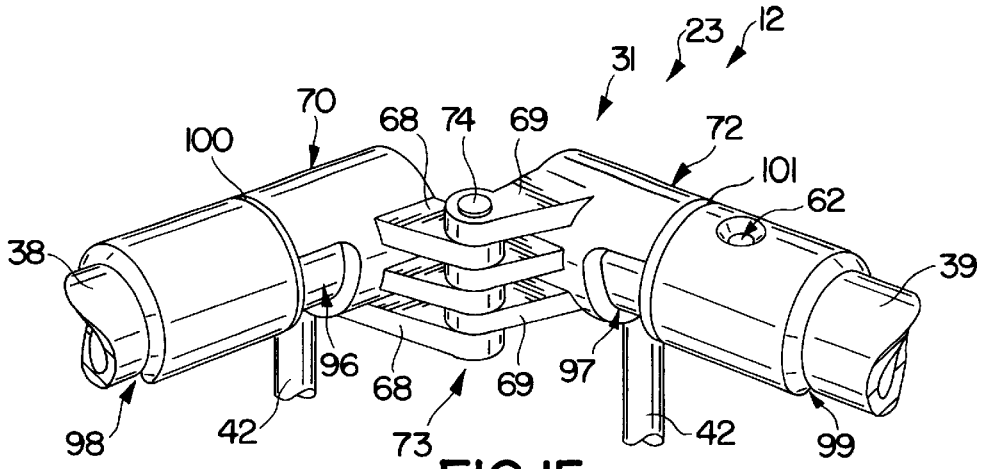
FIG. 15 is a view similar to FIG. 13 showing the lock mechanism in the unlocked position and the button-shaped portion of the lock member pushed inwardly so that left and right spindle sets of the bifold end panel pivot about the vertical hinge pin allowing the left and right spindle sets to fold inwardly so that the frame assumes the collapsed, portable position.

To collapse crib 10, lock mechanism 31 is pushed in direction 94, as shown in FIG. 13, and bifold end panel 23 begins to fold inwardly, as shown in FIG. 15. Lock mechanism 31 cannot move in a direction opposite arrow 94 because, as shown in FIG. 14, outer surfaces 86, 87 of first and second members 70, 72 abut one another to prevent first and second members 70, 72 from hinging about hinge pin 74 in such a manner. As top rail segment 54 is pushed in direction 94, first frame portion 11 pivots relative to second frame portion 13 about axis 66 so that frame 12 reaches its fully-collapsed position shown in FIG. 16. In the fully-collapsed position, with both bifold end panels 23, 24 folded inwardly, bifold end panels 23, 24 and side panels 21, 22 cooperate to define a first channel 110, a second channel 112, and a third channel 114 for storage of the mattress-support platform 16 and the mattress 18. First channel 110 extends longitudinally between vertical spindles 42 of left and right spindle sets 28, 30 and is bounded in height between lock mechanisms 31, 32 and stationary hinges 33, 34. The mattress-support platform 16 and/or mattress 18 can be positioned in first channel 110 so that they rest on stationary hinges 33, 34 between vertical spindles 42.

Second channel 112 and third channel 114 extend longitudinally between vertical spindles 42 of left and right spindle sets 28, 30 respectively, and vertical spindles 27 of side panels 21, 22. Second and third channels 112, 114 are each bounded in height between upper mounting brackets 46, 47 and lower mounting brackets 48, 49, respectively. The mattress-support platform 16 and/or mattress 18 can be positioned in the second or third channel 112, 114 so that they rest on the lower mounting brackets 48, 49 connected to the respective side panel 22.

Once frame 12 is fully collapsed, it can be stored easily in a closet or the like by rolling frame 12 on casters 20. Crib 10 can later be retrieved and unfolded simply by removing mattress-support platform 16 and mattress 18 from their respective portable positions, pulling apart side panels 21, 22 so that bifold end panels 23, 24 pivot about hinge 73 and stationary hinges 33, 34 and move towards the unlocked position shown in FIG. 13, and rotating lock mechanisms 31, 32 in direction 95, shown in FIG. 13 to move the lock mechanisms 31, 32 to the locked position shown in FIG. 10.

Although the invention has been described in detail with reference to certain preferred embodiments, variations and modifications exist within the scope and spirit of the invention as described and defined in the following claims.

It is claimed:

1. A juvenile crib frame comprising a first frame portion, a second frame portion, and a lock mechanism having a first member mounted for rotation on the first frame portion, a second member mounted for rotation on the second frame portion, and a hinge pin that couples the first member to the second member for pivotable movement of the first member relative to the second member about an axis defined by the hinge pin that is perpendicular to the axis of rotation of at least one lock mechanism member relative to its companion frame portion.

2. The frame of claim 1, wherein the first frame portion includes a first panel and a second panel pivotably coupled to the first panel and the first member of the lock mechanism is rotatably mounted on the first panel.

3. The frame of claim 2, wherein the second frame portion includes a first panel and a second panel pivotably coupled to the first panel of the second frame portion, the second member of the lock mechanism is rotatably mounted on the first panel of the second frame portion, and the second panel of the second frame portion is coupled to the second panel of the first frame portion.

4. The frame of claim 2, wherein the first frame portion further includes a third panel having one end pivotably coupled to the second panel and a second end pivotably coupled to the second frame portion.

5. The frame of claim 1, wherein the first and second frame portions each include a horizontal top rail and the lock mechanism is mounted for rotation between the horizontal top rails.

6. The frame of claim 5, wherein the first and second frame portions each include a first panel and a second panel pivotably coupled to its companion first panel and the lock mechanism is rotatably mounted between the first panels.

7. The frame of claim 5, further comprising a stationary hinge defining a vertical hinging axis wherein the first and second frame portions each further include a horizontal bottom rail in spaced apart relation to the top rail and the stationary hinge is mounted between the horizontal bottom rails.

8. The frame of claim 1, wherein the first and second frame portions each include a first panel and a second panel pivotably coupled to its companion first panel, the second panel of the first frame portion being pivotably coupled to the second panel of the second frame portion.

9. The frame of claim 8, further comprising a second lock mechanism that pivotably couples the second panel of the first frame portion to the second panel of the second frame portion.

10. The frame of claim 8, wherein the first and second frame portions each further include a third panel pivotably coupled to its companion second panel and pivotably coupled to one another.

11. The frame of claim 1, wherein the lock mechanism is in a locked position when the hinge pin is horizontal so that the first frame portion cannot pivot relative to the second frame portion and the lock mechanism is in an unlocked position when the hinge pin is vertical so that the first frame portion can pivot relative to the second frame portion.

12. The frame of claim 11, wherein the first and second frame portions each include a horizontal top rail and the lock mechanism is mounted for rotation on the horizontal top rails.

13. The frame of claim 11, further comprising a stationary hinge mounted between the first and second frame portions in spaced-apart relation to the lock mechanism, the stationary hinge pivotably coupling the first frame portion to the second frame portion and defining a vertical hinging axis.

14. The frame of claim 1, wherein the first and second frame portions each includes a first end and an opposite second end, the first member of the lock mechanism being mounted on the first end of the first frame portion and the second member of the lock mechanism being mounted on the first end of the second frame portion.

15. The frame of claim 14, wherein a coupling couples the second end of the first frame portion to the second end of the second frame portion such that the second end of the first frame portion can pivot relative to the second end of the second frame portion about an axis defined by the coupling.

16. The frame of claim 1, wherein the first and second frame portions are spindle sets and include a horizontal top rail, an opposite horizontal bottom rail, and a plurality of vertical spindles extending vertically between the top and bottom rails.

17. The frame of claim 16, wherein the first and second members of the lock mechanism are formed to include a pair of longitudinal slot portions to enable the lock mechanism to be installed onto the top rails of the first and second frame portions without being blocked by the vertical spindles.

18. The frame of claim 16, wherein the first and second members of the lock mechanism are formed to include a pair of circumferential slot portions to enable the lock mechanism to rotate about the top rails without interference from the vertical spindles.

19. The frame of claim 1, wherein the lock mechanism is mounted for rotation on the first and second frame portions between a locked position wherein the first and second members are prevented from pivoting relative to one another about the axis defined by the hinge pin and an unlocked position wherein the first and second members are free to pivot relative to one another about the axis defined by the hinge pin.

20. The frame of claim 19, wherein the lock mechanism includes a lock member that engages the second frame portion when the lock mechanism is in the locked position to inhibit the lock mechanism from inadvertently moving to the unlocked position.

21. A juvenile crib frame comprising a first frame portion having a first end and a second end, a second frame portion having a first end and a second end, a first lock mechanism having a first member mounted for rotation on the first end of the first frame portion, a second member mounted for rotation on the first end of the second frame portion, and a coupling that couples the first member to the second member for pivotable movement of the first lock mechanism about an axis that is perpendicular to the axis of rotation of at least one member of the first lock mechanism relative to its companion frame portion, and a second lock mechanism having a first member mounted for rotation on the second end of the first frame portion, a second member mounted for rotation on the second end of the second frame portion, and a coupling that couples the first member of the second lock mechanism to the second member of the second lock mechanism for pivotable movement of the second lock mechanism about an axis that is perpendicular to the axis of rotation of at least one member of the second lock mechanism relative to its companion frame portion.

22. The frame of claim 21, wherein the first frame portion includes a first panel and a second panel pivotably coupled to the first panel and the first member of the first lock mechanism is rotatably mounted on the first panel.

23. The frame of claim 22, wherein the second frame portion includes a first panel and a second panel pivotably coupled to the first panel of the second frame portion, the second member of the lock mechanism is rotatably mounted on the first panel of the second frame portion, and the second panel of the second frame portion is coupled to the second panel of the first frame portion.

24. The frame of claim 22, wherein the first frame portion further includes a third panel having one end pivotably coupled to the second panel and a second end pivotably coupled to the second frame portion.

25. The frame of claim 21, wherein the first and second frame portions each include a horizontal top rail and the first lock mechanism is mounted for rotation between the horizontal top rails.

26. The frame of claim 25, wherein the first and second frame portions each include a first panel and a second panel pivotably coupled to its companion first panel and the first lock mechanism is rotatably mounted between the first panels.

27. The frame of claim 25, further comprising a stationary hinge defining a vertical hinging axis wherein the first and second frame portions each further include a horizontal bottom rail in spaced-apart relation to the top rail and the stationary hinge is mounted between the horizontal bottom rails.

28. A juvenile crib frame comprising a first frame portion having a first end and an opposite second end, a second frame portion having a first end and an opposite second end, a first lock mechanism having a first member mounted for rotation on the first end of the first frame portion, a second member mounted for rotation on the first end of the second frame portion, and a coupling that couples the first member to the second member for pivotable movement of the first lock mechanism about an axis that is perpendicular to the axis of rotation of at least one member of the first lock mechanism relative to its companion frame portion, a second lock mechanism having a first member mounted for rotation on the second end of the first frame portion, a second member mounted for rotation on the second end of the second frame portion, and a coupling that couples the first member of the second lock mechanism to the second member of the second lock mechanism for pivotable movement of the second lock mechanism about an axis that is perpendicular to the axis of rotation of at least one member of the second lock mechanism relative to its companion frame portion, a first hinge coupled to the first ends of the first and second frame portions and in spaced-apart relation to the first lock mechanism to define a vertical pivot axis, and a second hinge coupled to the second ends of the first and second frame portions and in spaced-apart relation to the second lock mechanism to define a vertical pivot axis.

29. The frame of claim 28, wherein the first ends of the first and second frame portions can pivot relative to one another only when the first lock mechanism is rotated to define a vertical pivot axis.

30. The frame of claim 29, wherein the second ends of the first and second frame portions can pivot relative to one another only when the second lock mechanism is rotated to define a vertical pivot axis.

31. The frame of claim 29, wherein the first lock mechanism is formed to include slot portions that restrict rotation of the first lock mechanism to ninety degrees between a horizontal and vertical position.

32. The frame of claim 28, wherein the first and second frame portions are spindle sets including a top rail, an opposite bottom rail, and a plurality of vertical spindles interconnecting the top and bottom spindles.

33. The frame of claim 32, wherein the first and second lock mechanisms are mounted to the top rails of first and second frame portions.

34. The frame of claim 32, wherein the first and second hinges are mounted to the bottom rails of the first and second frame portions.

35. The frame of claim 32, wherein the first and second lock mechanisms are formed to include at least one slot portion configured to receive at least one vertical spindle to restrict rotation of the first lock mechanism relative to the spindle sets.

* * * * *